US006823775B1

(12) United States Patent
Berkes

(10) Patent No.: US 6,823,775 B1
(45) Date of Patent: Nov. 30, 2004

(54) PAPER BUNDLING DEVICE

(76) Inventor: Mark Berkes, 01 N. Joshua La., Kunkletown, PA (US) 18058

( * ) Notice: Subject to any disclaimer, the term of this patent is extended or adjusted under 35 U.S.C. 154(b) by 0 days.

(21) Appl. No.: 10/122,905

(22) Filed: Apr. 12, 2002

(51) Int. Cl.[7] ..... B30B 9/30
(52) U.S. Cl. ..... 100/8; 100/34
(58) Field of Search ..... 100/8, 34, 32; 414/788, 788.1; 53/528, 529, 590, 592

(56) References Cited

U.S. PATENT DOCUMENTS

| | | | | | |
|---|---|---|---|---|---|
| 956,387 | A | * | 4/1910 | Magson | 100/34 |
| 4,154,159 | A | * | 5/1979 | Ortega | 100/34 |
| 5,159,875 | A | * | 11/1992 | Cohen | 100/34 |
| 5,230,282 | A | * | 7/1993 | Barnes | 100/34 |
| 5,282,545 | A | * | 2/1994 | White | 100/34 |
| 5,575,199 | A | * | 11/1996 | Yamamoto | 100/34 |
| 6,374,728 | B1 | * | 4/2002 | Baillie | 100/34 |

* cited by examiner

*Primary Examiner*—Allen Ostrager
*Assistant Examiner*—Shelley Self
(74) *Attorney, Agent, or Firm*—Goldstein Law Offices, P.C.

(57) ABSTRACT

A paper bundling device that will allow newspapers and magazines and be stacked together and tied including a plate bracket assembly comprised of a pair of spaced apart vertical rails each being defined by an elongated vertical track. The rails each have a fixed horizontal stabilizer bar extending between upper ends thereof. The rails each have fixed horizontal supports extending outwardly from lower ends thereof to support a bundle of newspapers thereon. The fixed horizontal stabilizer bar has a pair of notched spacer bar extending downwardly therefrom inwardly of the rails. The plate bracket assembly includes a movable horizontal stabilizer bar. The movable horizontal stabilizer bar has a pair of slide pins extending inwardly therefrom for selectively engaging the notched spacer bar. The plate bracket assembly includes a pair of movable horizontal bars coupled with the elongated vertical tracks of the vertical rails. The movable horizontal bars have the movable stabilizer bar extending therebetween. The movable horizontal bars are positionable atop the bundle of newspapers positioned on the fixed horizontal bars.

4 Claims, 3 Drawing Sheets

PAPER BUNDLING DEVICE

BACKGROUND OF THE INVENTION

The invention relates to a paper bundling device that will allow newspapers and magazines and be stacked together and tied.

Several references show various paper bundling devices. U.S. Pat. No. 5,533,381 to Murat discloses a newspaper storage and bundling system including a bin with side panels and four reels of rope extending down from the lid. U.S. Pat. No. 5,072,576 to Evans discloses a newspaper bundling device comprised of a pair of compartments each with a spool. U.S. Pat. No. 5,230,282 to Barnes and U.S. Pat. No. 5,282,545 to White disclose additional paper packaging systems.

While these units may be suitable for the particular purpose employed, or for general use, they would not be as suitable for the purposes of the present invention as disclosed hereafter.

SUMMARY OF THE INVENTION

It is an object of the invention to produce a paper bundling device that will allow newspapers and magazines and be stacked together and tied including a plate bracket assembly comprised of a pair of spaced apart vertical rails each being defined by an elongated vertical track. The rails each have a fixed horizontal stabilizer bar extending between upper ends thereof. The rails each have fixed horizontal supports extending outwardly from lower ends thereof. The fixed horizontal supports each have an offset outer portion. The offset outer portion has a pair of plates secured thereto. The pair of plates support a bundle of newspapers thereon. The fixed horizontal stabilizer bar has a pair of notched spacer bar extending downwardly therefrom inwardly of the rails. The plate bracket assembly includes a movable horizontal stabilizer bar. The movable horizontal stabilizer bar has a pair of slide pins extending inwardly therefrom for selectively engaging the notched spacer bar. The plate bracket assembly includes a pair of movable horizontal bars coupled with the elongated vertical tracks of the vertical rails. The movable horizontal bars have the movable stabilizer bar extending therebetween. The movable horizontal bars each have an offset outer portion. The offset outer portion has a pair of plates secured thereto. The movable horizontal bars are positionable atop the bundle of newspapers positioned on the fixed horizontal bars. A wall mountable bracket is securable to a selected wall area. The wall mountable bracket includes a corresponding bracket secured to the vertical rails of the plate bracket assembly whereby the plate bracket assembly can be mounted to the selected wall area. A pair of string guides extend downwardly from the offset outer portions of the movable horizontal bars of the plate bracket assembly. A spool of string holding bar is secured to one of the movable horizontal bars for holding a spool of string thereon.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

It will be noted in the various figures that the device relates to a paper bundling device that will allow newspapers and magazines and be stacked together and tied. In its broadest context, the device consists of a plate bracket assembly, a wall mountable bracket, a pair of string guides and a spool of string holding bar. Such components are individually configured and correlated with respect to each other so as to attain the desired objective.

Figure 1:
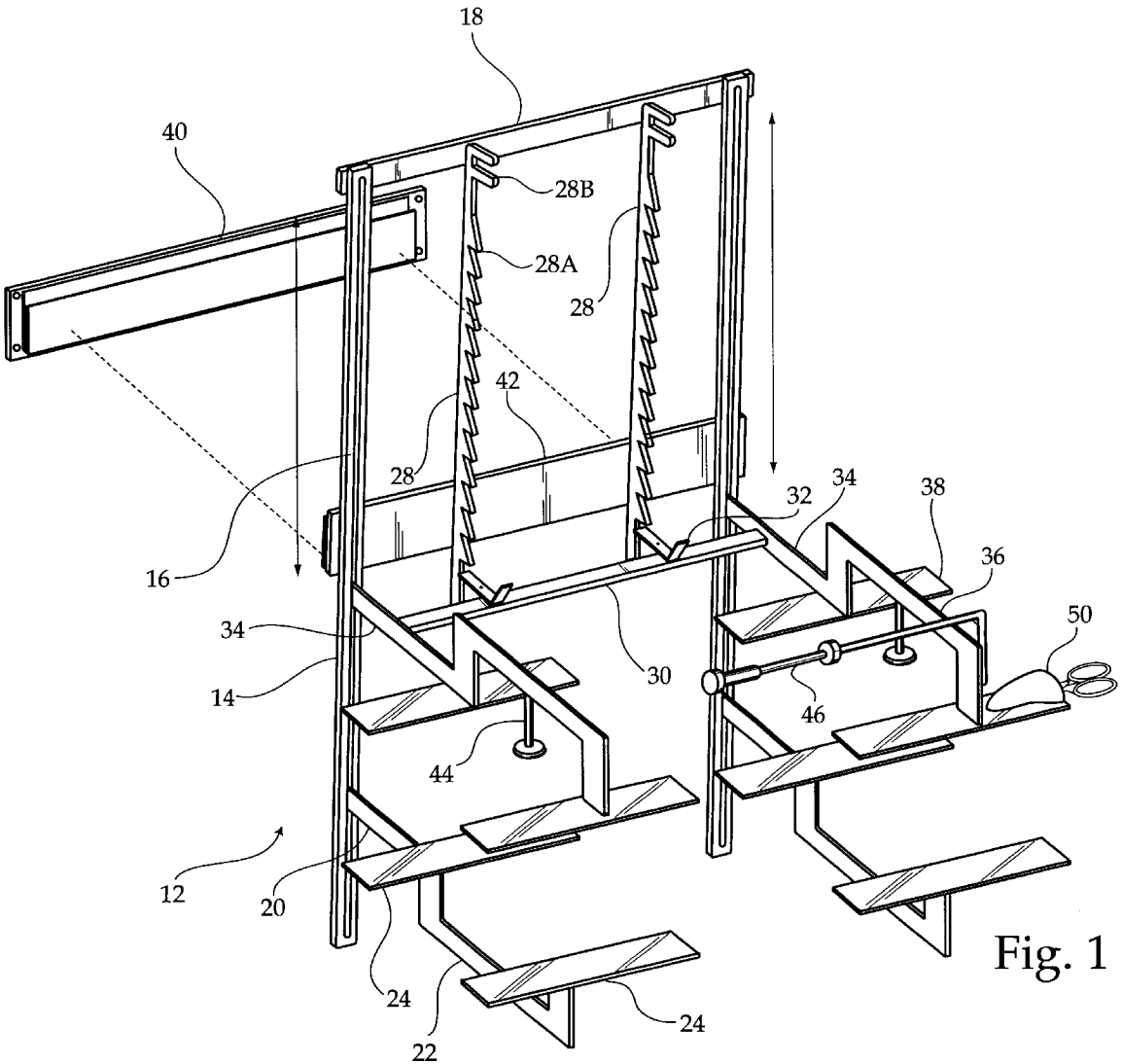
FIG. 1 is a perspective view of the present invention.
Figure 2:
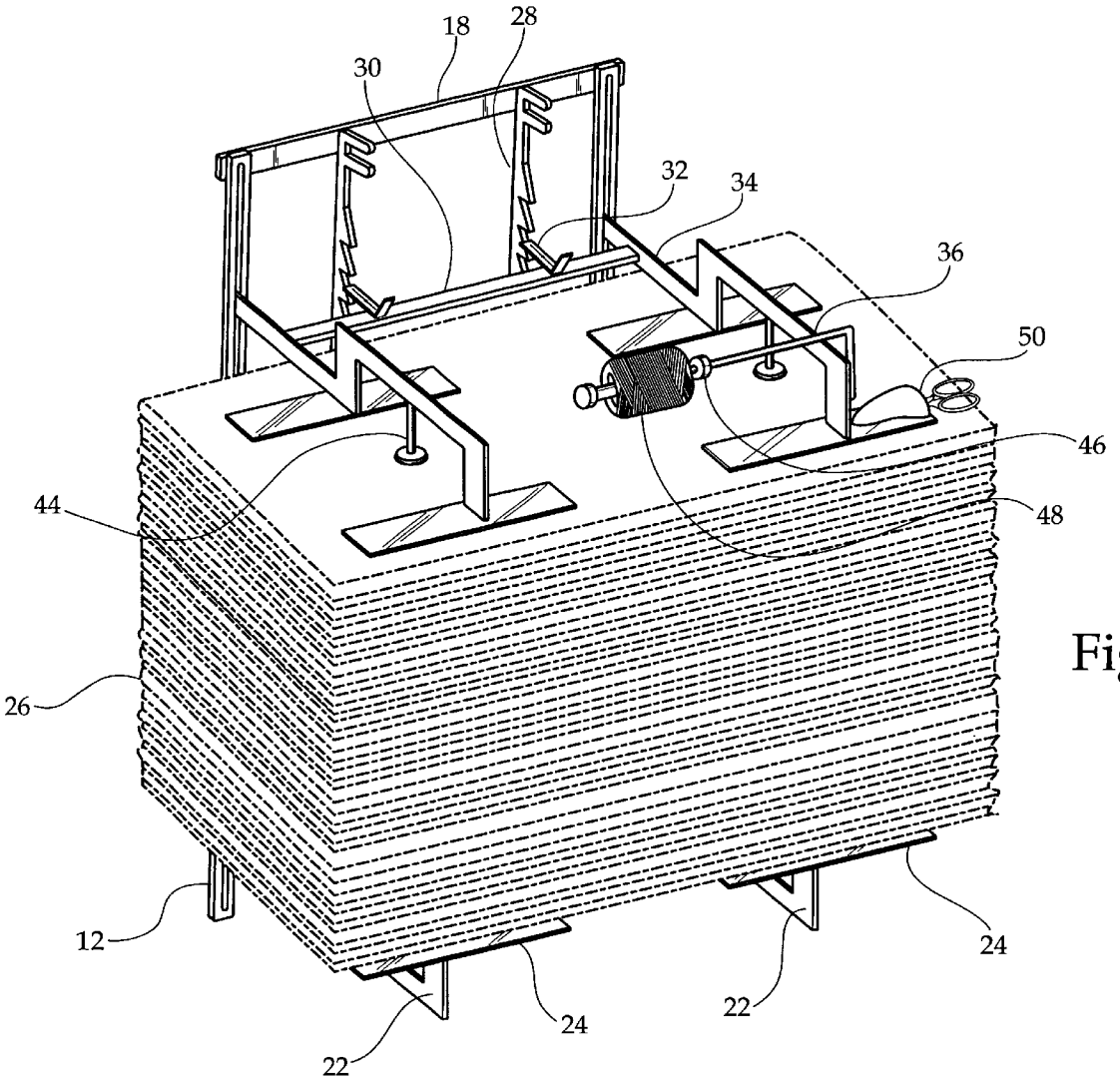
FIG. 2 is a perspective view of the present invention illustrated in use.
Figure 3:
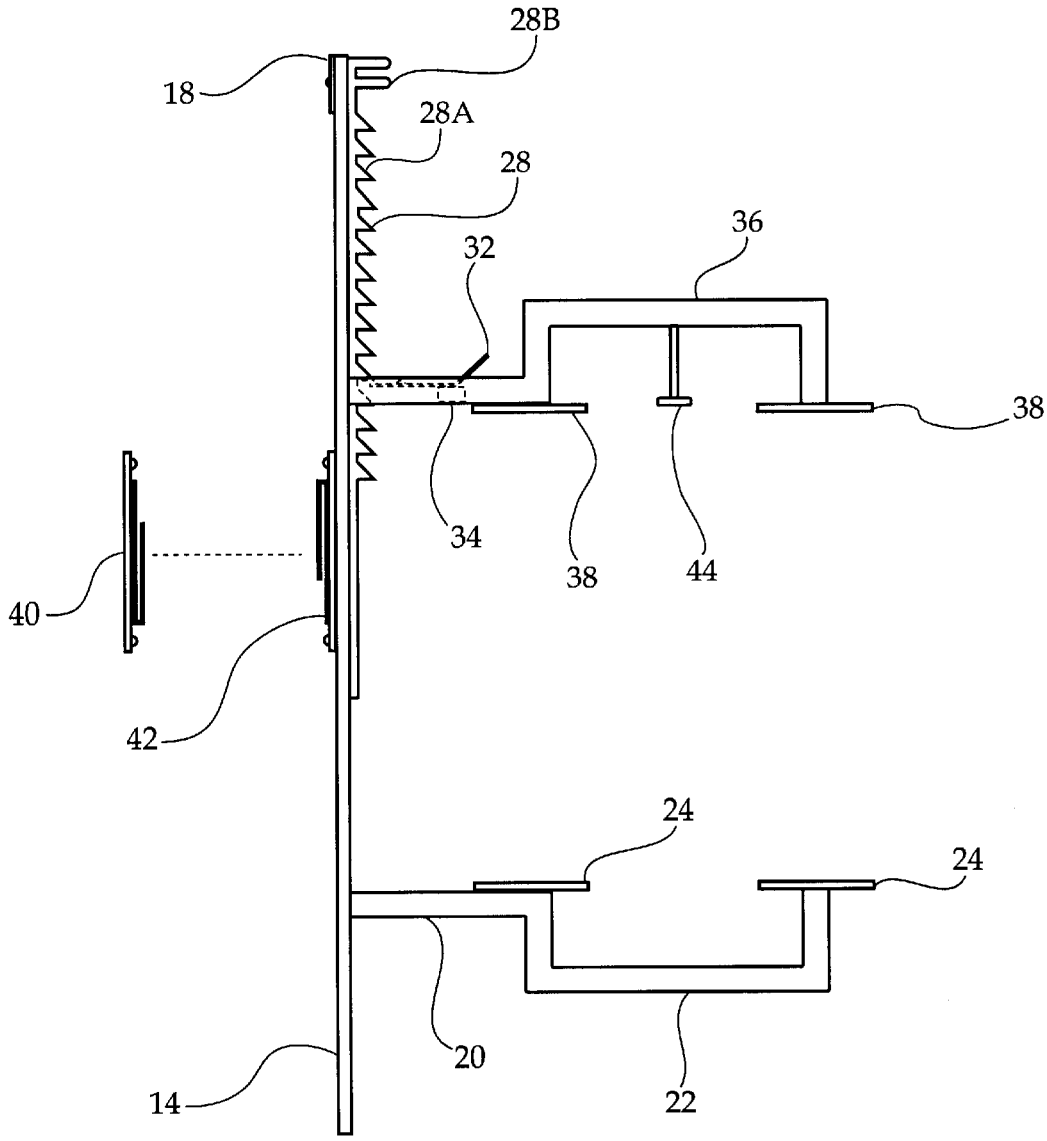
FIG. 3 is a side view of the present invention.

The plate bracket assembly 12 is comprised of a pair of spaced apart vertical rails 14 each being defined by an elongated vertical track 16. Note FIG. 1. The rails 14 each have a fixed horizontal stabilizer bar 18 extending between upper ends thereof. The rails 14 each have fixed horizontal supports 20 extending outwardly from lower ends thereof. The fixed horizontal supports 20 each have an offset outer portion 22. The offset outer portion 22 has a pair of plates 24 secured thereto. The pair of plates 24 support a bundle of newspapers 26 thereon. Note FIG. 2. The fixed horizontal stabilizer bar 18 has a pair of notched spacer bars 28 extending downwardly therefrom inwardly of the rails 14. The notched spacer bars 28 each include a plurality of ratcheting notches 28A, and a lock open notch 28B. The plate bracket assembly 12 includes a movable horizontal stabilizer bar 30. The movable horizontal stabilizer bar 30 has a pair of slide pins 32 extending inwardly therefrom for selectively engaging the notched spacer bar 28. The plate bracket assembly 12 includes a pair of movable horizontal bars 34 coupled with the elongated vertical tracks 16 of the vertical rails 14. The movable horizontal bars 34 have the movable stabilizer bar 30 extending therebetween. The movable horizontal bars 34 each have an offset outer portion 36. The offset outer portion 36 has a pair of plates 38 secured thereto. The movable horizontal bars 34 are positionable atop the bundle of newspapers 26 positioned on the fixed horizontal bars 20. In particular, the slide pins 32 are engaged with the lock open notches 28B atop the notched spacer bars to hold the movable stabilizer bar 30 and horizontal stabilizer bar 34 in an upward position so that newspapers can,be loaded. In addition once the newspapers are in place, the slide pins 32 are engaged with the ratcheting notches 28A to hold the plates 38 tensioned downward against the newspapers.

The wall mountable bracket 40 is securable to a selected wall area. The wall mountable bracket 40 includes a corresponding bracket 42 secured to the vertical rails 14 of the plate bracket assembly 12 whereby the plate bracket assembly 12 can be selectively mounted to the selected wall area and easily removed therefrom.

The pair of string guides 44 extend downwardly from the offset outer portions 36 of the movable horizontal bars 34 of the plate bracket assembly 12.

The spool of string holding bar 46 is secured to one of the movable horizontal bars 34 for holding a spool of string 48 thereon.

In use, the stack of newspapers 26 or magazines are placed on the plates 24 of the fixed horizontal bars 20. Once the desired stack is in place, the user then pulls outwardly on the slide pins 32 to allow the movable stabilizer bar 30 and the movable horizontal bars 34 to be moved downwardly until the plates 38 are in an abutting relationship with the stack 26, and downward pressure is manually applied to the stack 26. Then, the slide pins 32 are engaged with notches on the notched spacer bars 28 to maintain downward tension on the stack. The user can then use the spool of string 48 to extend string around the stack utilizing the string guides 44 to properly position the string from "side-to-side" around the stack 26. For convenience, a pair of scissors holder 50 is provided on one of the plates 38. The notched spacer bars 28 further allow an opening in the back of the stack 26 to pass the string around the stack 26 from front to back, beneath and around the bundles, thus allowing the bundles to be bound in both directions. Accordingly, Once the stack 26 has been tied with string, the string can be cut, and the stack 26 can be removed from the present invention by raising the movable stabilizer bar 30 to the lock open notches 28B and the movable horizontal bars 34 after the slide pins 32 have been pulled outwardly from the ratcheting notches 28A. Thus, the stabilizer bar 30 will be maintained in an upward position until a suitable stack of newspapers has been accumulated on the plates 24 to prompt bundling by the user.

In conclusion, herein is presented a device for facilitating easy and secure bundling of magazines, newspapers and the like. The invention has been illustrated by example in the foregoing description and the accompanying drawings. However numerous variations are possible while adhering to the inventive concepts. Such variations are contemplated as being a part of the present invention.

What is claimed is:

1. A paper bundling device that will allow newspapers and magazines to be stacked together and tied, comprising:

a pair of spaced apart vertical rails each being defined by an elongated vertical track;

a fixed horizontal stabilizer bar extending between upper ends of the spaced apart vertical rails, the fixed horizontal stabilizer bar having a pair of notched spacer bar extending downwardly therefrom inwardly of the rails;

a pair of fixed horizontal supports extending outwardly from lower ends of the spaced apart vertical rails, the fixed horizontal supports each having an offset outer portion, the offset outer portion having a pair of plates secured thereabove, the pair of plates supporting a bundle of newspapers thereon;

a movable horizontal stabilizer bar having a pair of slide pins extending inwardly therefrom for selectively engaging the notched spacer bar, a pair of movable horizontal bars slidably coupled with the elongated vertical tracks of the vertical rails for guiding vertical movement of the horizontal stabilizer bar, the movable stabilizer bar extending between the movable horizontal bars, the movable horizontal bars each having an offset outer portion, said offset outer portion having a pair of plates secured therebeneath, a scissor holder attached to one of said plates, the movable horizontal bars being positionable atop the bundle of newspapers positioned on the fixed horizontal bars;

a wall mountable bracket securable to a selected wall area;

a corresponding bracket secured to the vertical rails of the plate bracket assembly for selectively securing to the wall mountable bracket whereby the vertical rails can be mounted to the selected wall area, and easily removed therefrom;

a pair of string guides extending downwardly from the offset outer portions of the movable horizontal bars of the plate bracket assembly; and a spool of string holding bar secured to one of the movable horizontal bars for holding a spool of string thereon and extending laterally, substantially parallel to the plates attached to the offset outer portions of the movable horizontal bars.

2. A paper bundling device that will allow newspapers and magazines to be stacked together and tied, comprising:

a pair of spaced apart vertical rails each being defined by an elongated vertical track;

a fixed horizontal stabilizer bar extending between upper ends of the spaced apart vertical rails, the fixed horizontal stabilizer bar having a pair of notched spacer bars extending downwardly therefrom vertically, substantially parallel to and inwardly of the rails, the notched spacer bars also attached to the fixed horizontal stabilizer bar;

a pair of fixed horizontal supports extending outwardly from lower ends thereof, a pair of plates secured atop the fixed horizontal supports, the pair of plates supporting a bundle of newspapers thereon;

a movable horizontal stabilizer bar having a pair of slide pins extending inwardly therefrom for selectively engaging the notched spacer bar, a pair of movable horizontal bars slidably coupled with the elongated vertical tracks of the vertical rails for guiding vertical movement of the horizontal stabilizer bar, the movable stabilizer bar extending between the movable horizontal bars, the movable horizontal bars each have an offset outer portion, a pair of plates secured are secured to the offset outer portion and extend below the movable horizontal bars, the movable horizontal bars being positionable atop the bundle of newspapers positioned on the fixed horizontal bars;

a pair of string guides extending downwardly from the offset outer portions of the movable horizontal bars of the plate bracket assembly; and a spool of string holding bar secured to one of the movable horizontal bars for holding a spool of string thereon and extending laterally, substantially parallel to the plates attached to the offset outer portions of the movable horizontal bars.

3. The paper bundling device as recited in claim 2, the fixed horizontal supports each having an offset outer portion, the plates secured to the offset outer portion.

4. The paper bundling device as recited in claim 3, further comprising:

a wall mountable bracket securable to a selected wall area; and a corresponding bracket secured to the vertical rails of the plate bracket assembly for selectively securing to the wall mountable bracket whereby the vertical rails can be mounted to the selected wall area, and easily removed therefrom.

* * * * *